United States Patent [19]

DeGuvera

[11] Patent Number: 4,716,810

[45] Date of Patent: Jan. 5, 1988

[54] SELF-CONTAINED ARMOR ASSEMBLY

[75] Inventor: Emmett W. DeGuvera, Grosse Pointe Woods, Mich.

[73] Assignee: Detroit Punch & Retainer Corporation, Fraser, Mich.

[21] Appl. No.: 832,440

[22] Filed: Feb. 24, 1986

[51] Int. Cl.[4] ..... F41H 5/04

[52] U.S. Cl. ..... 89/36.02; 109/83; 428/71; 428/911

[58] Field of Search ..... 52/309.7, 309.9, 309.11; 89/36.02, 36.08; 109/80, 82, 83, 84; 428/71, 911

[56] References Cited

U.S. PATENT DOCUMENTS

| | | | |
|---|---|---|---|
| 3,351,374 | 11/1967 | Forsyth et al. | 89/36.02 |
| 4,398,446 | 8/1983 | Pagano et al. | 89/36.08 |
| 4,455,801 | 6/1984 | Merritt | 109/84 |
| 4,462,194 | 7/1984 | Wahner | 52/309.11 |
| 4,585,683 | 4/1986 | Curnow | 428/71 |

FOREIGN PATENT DOCUMENTS

| | | | |
|---|---|---|---|
| 341015 | 9/1921 | Fed. Rep. of Germany | 109/84 |
| 503320 | 6/1920 | France | 89/36.02 |

OTHER PUBLICATIONS

The DURA-PLEX Fiberglass/Polyurethane Sandwich Panel Building System, Jun. 2, 1980.

*Primary Examiner*—Stephen C. Bentley
*Attorney, Agent, or Firm*—Barnes, Kisselle, Raisch, Choate, Whittemore & Hulbert

[57] ABSTRACT

A self-contained armor assembly comprising a panel unit including a pair of armor plates in spaced parallel relation to one another. The panel unit is embedded in a resinous plastic material within a casing providing a sealed package for protecting the panel unit from the elements. Mounting stud fasteners are provided for detachably mounting the armor assembly on a wall of a military vehicle or the like.

3 Claims, 6 Drawing Figures

SELF-CONTAINED ARMOR ASSEMBLY

This invention relates generally to armor and refers more particularly to a self-contained armor assembly adapted to be detachably mounted on a military vehicle or the like.

SUMMARY OF THE INVENTION

One object of this invention is to provide a self-contained armor assembly adapted to be detachably mounted on a wall of a military vehicle or the like comprising a panel unit, a casing in which the panel unit is housed, and a foamed plastic material in the casing in which the panel unit is embedded and encapsulated.

More specifically, the panel unit comprises a pair of armor plates, and means for clamping the armor plates in spaced generally parallel relation including one or more space retainers extending through the plates. Each space retainer has an enlarged central body portion and reduced end portions. Nuts threaded on the end portions clamp the armor plates against the central body portion. Preferably the casing is made of glass fiber-reinforced plastic sheets and the foamed plastic material is expanded urethane.

The panel assembly is detachably mounted on a wall of a military vehicle or the like by mounting stud fasteners which extend through the armor plates and through central passages in the space retainers. The mounting stud fasteners are preferably made of nylon.

The panel assembly of this invention has numerous advantages. It is a self-contained assembly capable of being stored as a unit. The armor plates, which usually are of metal, are fully encapsulated in a plastic encasement to prevent them from oxidizing or presenting sharp edges which might cause injury. The panel assembly is capable of being readily and rapidly mounted on a vehicle. The assembly in most cases will be buoyant, thus not adding any weight to an amphibian vehicle while in the water. The plate is inside the casing and thus completely hidden. In addition, the self-contained armor assembly of this invention is relatively inexpensive to manufacture.

These and other objects of the invention will become more apparent as the description proceeds, especially when considered with the accompanying drawings.

DETAILED DESCRIPTION

Figure 1:
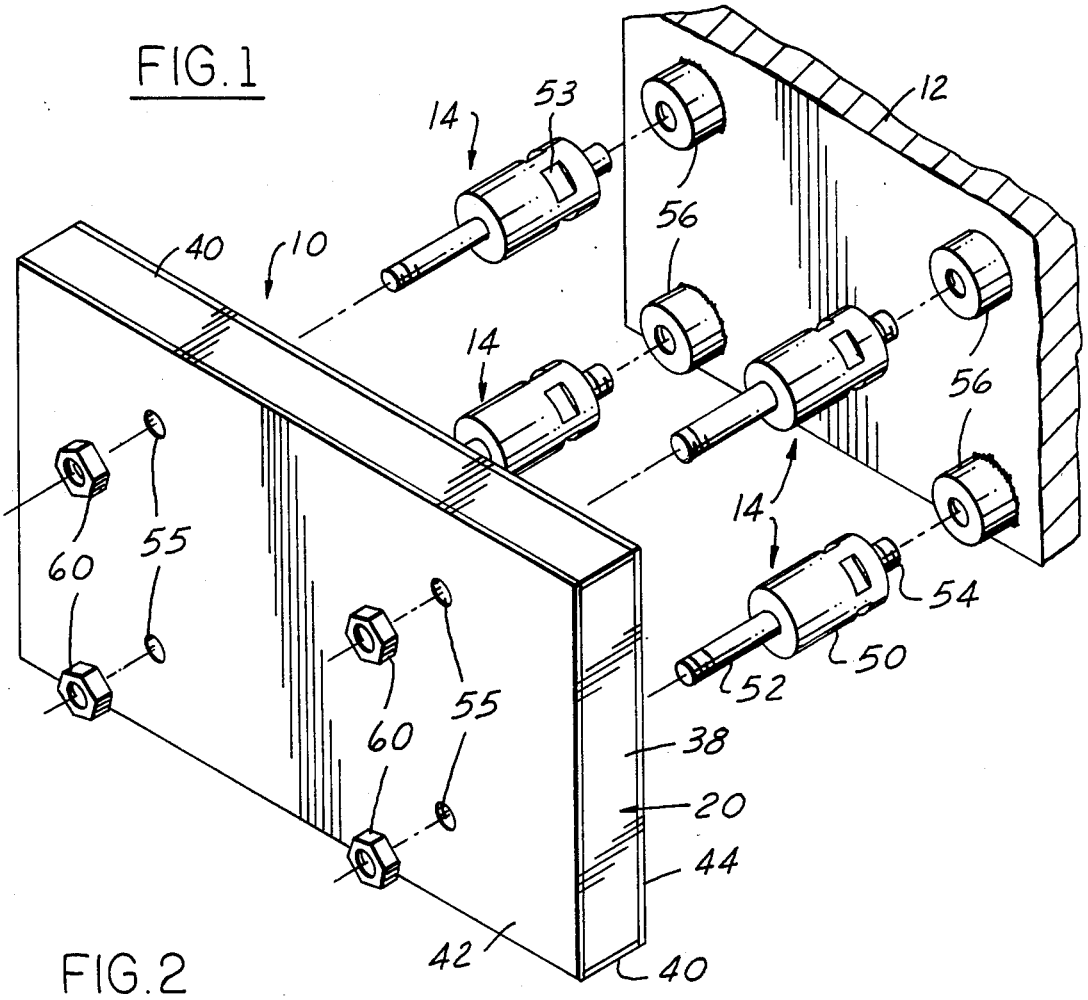
FIG. 1 is an exploded perspective view of a self-contained armor assembly constructed in accordance with my invention.
Figure 2:
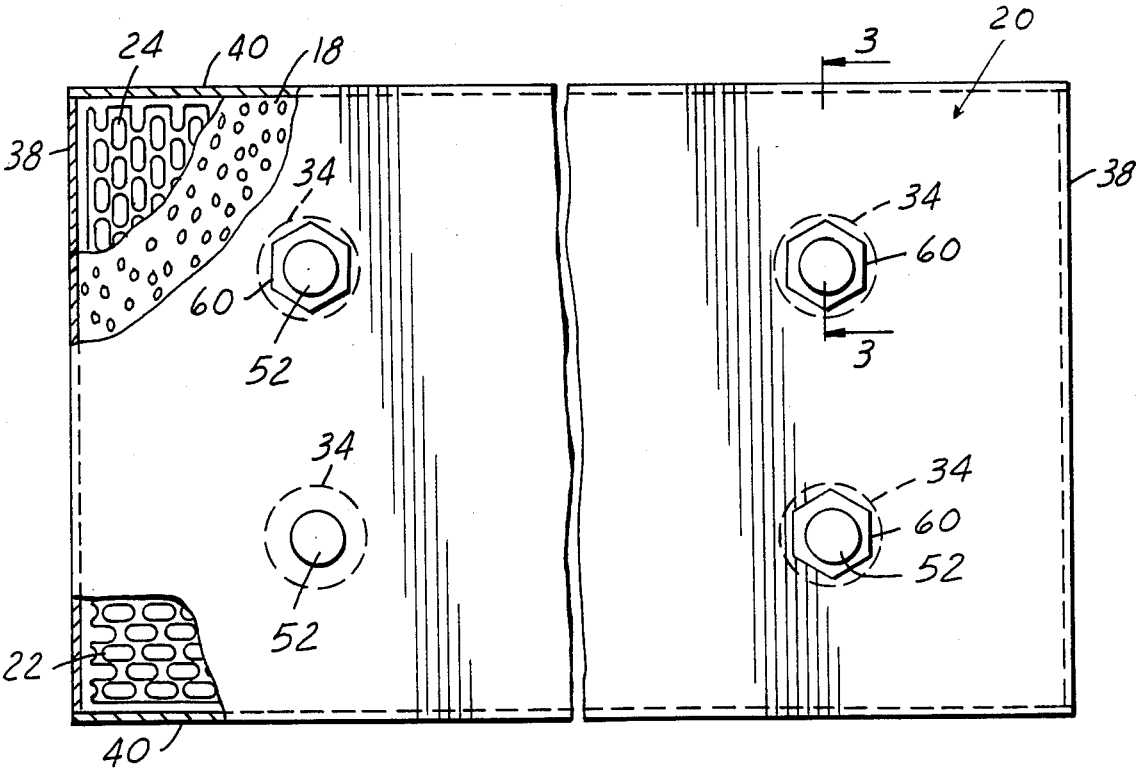
FIG. 2 is a plan view, with parts broken away, of the armor assembly shown in FIG. 1.
Figure 3:
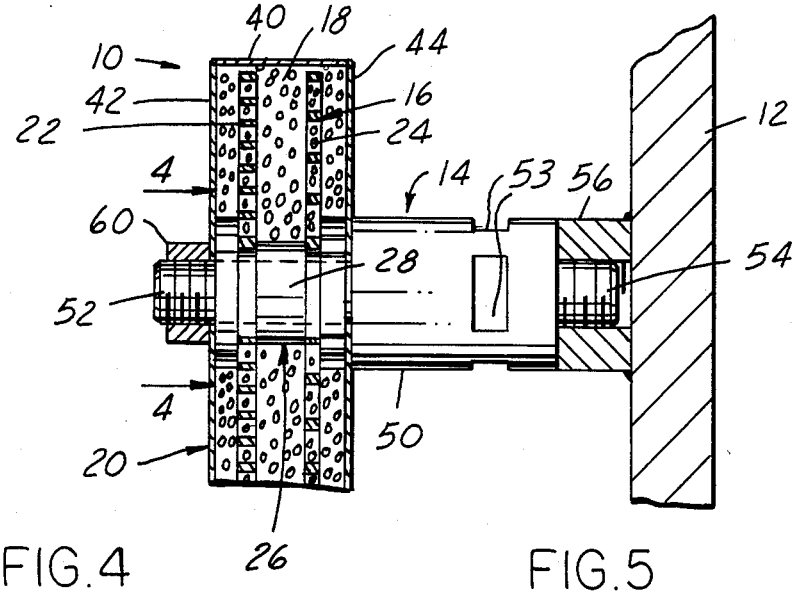
FIG. 3 is a fragmentary sectional view taken along the line 3—3 in FIG. 2.
Figure 4:
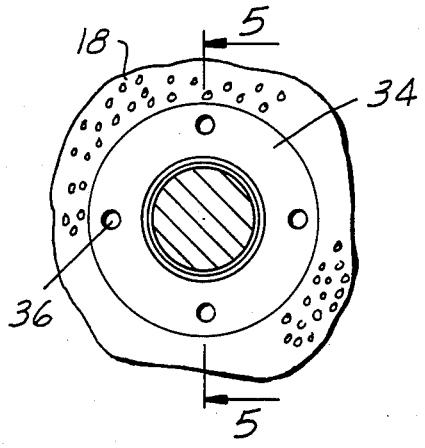
FIG. 4 is a view taken along the line 4—4 in FIG. 3.
Figure 5:
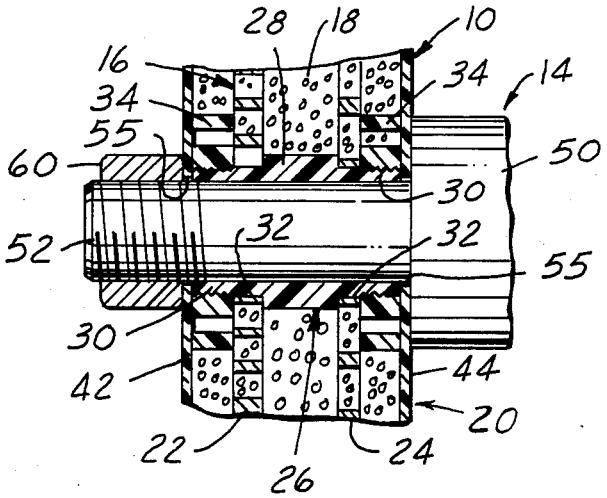
FIG. 5 is a sectional view taken along the line 5—5 in FIG. 4.

Referring now more particularly to the drawings and especially to FIGS. 1–5 thereof, there is shown a self-contained armor assembly 10 detachably mounted on a wall 12 of a military vehicle or the like by a plurality of mounting stud fasteners 14.

The armor assembly 10 includes a panel unit 16 embedded in a foamed resinous plastic material 18 within a casing 20.

The panel unit has a pair of rectangular perforated steel armor plates 22 and 24 which are of the same length and width and of conventional construction. Means are provided for clamping the armor plates 22 and 24 in spaced parallel relation comprising a plurality of space retainers 26. The space retainers 26 are of identical construction and are spaced from one another in a rectangular or any other pattern. Each space retainer 26 is in the form of an elongated tubular member having a cylindrical body portion 28 and reduced threaded end portions 30. The two armor plates 22 and 24 have matching circular holes 32 at each space retainer location which are of the same size as the reduced threaded end portions 30, or slightly larger, so that the threaded end portions 30 may extend into the matching holes 32 as shown. Ring nuts 34 are threaded on the end portions 30 and have holes 36 for receiving a suitable wrench by means of which the nuts may be tightened or loosened. When tightened, nuts 34 clamp the armor platers 22, 24 firmly against the ends of the central body portion 30 of each space retainer is spaced, parallel, overlying relation.

The armor plates 22, 24, space retainers 26 and nuts 34 together make up the panel unit 16 which forms the principal component of the armor assembly. Preferably the space retainers 26 and nuts 34 are made of a suitable plastic material such as nylon.

As stated above, the panel unit 16 is embedded in a foamed resinous plastic material 18 within the casing 20. The casing 20 is of a rectangular configuration similar to that of the panel unit 16, being just slightly wider and longer than the armor plates so as to provide a slight space between the edges of the armor plates and the side and end walls 38 and 40 of the casing. These side and end walls join the rectangular front and rear walls 42 and 44 of the casing to form a sealed casing. The front and rear walls 42 and 44 are parallel and bear up against nuts 34 and the ends of the reduced end portions 30 of space retainers 26. The casing is made entirely of a suitable plastic material, preferably reinforced with glass fibers.

The foamed resinous plastic material 18 in which the panel unit is embedded within the casing is preferably expanded urethane. The urethane foam completely encapsulates the panel unit, expanding to fill all of the space surrounding the panel unit, including the edges and front and rear sides of the armor plates to provide a further seal of protection for the armor plates. The sealed package provided by the casing and the foamed plastic 18 protects the panel unit, and in particular the armor plates, from the deleterious effects of the ambient environment including both air and moisture. The package also protects the sharp edges of the armor plates from causing injury.

The armor assembly 10 consisting of the panel unit 16, casing 20 and encapsulating foam 18 provides a complete package capable of being stored as a unit ready at all times to be mounted on any wall requiring protection from enemy projectiles, such, for example, as the wall of a military vehicle.

The armor assembly 10 is shown mounted on a wall 12, which may be the wall of a military vehicle, by means including the elongated mounting stud fasteners 14. These mounting stud fasteners are of identical construction, each having a cylindrical main body portion 50 with an elongated, cylindrical, reduced end portion 52 at one end and a somewhat shorter cylindrical reduced end portion 54 at the opposite end. Both end portions are threaded. The shorter of the two threaded end portions 54 is adapted to thread into a boss 56 pre-welded onto the wall 12 to be protected. On the body 50 of the fasteners 14 are flats 53 to receive a wrench. There are a plurality of such bosses pre-welded to the wall 12 in the same spaced relationship as the space retainers 26 of the panel unit 16. The elongated reduced end portions 52 are of a diameter similar to the inside diameter of the tubular space retainers so that the armor assembly 10 may be mounted on the fasteners by causing the reduced end portions 52 of the fasteners to project through the space retainers. Holes 55 in the front and rear walls 42 and 44 of the casing clear the end portions 52. The armor assembly 10 is thus mounted on the reduced end portions 52 and clamped up against the main body portions 50 thereof by nuts 60 threaded on the reduced end portions 52. The fasteners 14 and nuts 60 are preferably of nylon.

By first mounting the stud fasteners 14 on the bosses 56, then mounting the armor assembly 10 on the reduced end portions 52 of the fasteners and applying and tightening the nuts 60, the armor assembly 10 can be quickly and easily installed upon the wall of a vehicle.

The expanded urethane 18 is preferably foamed in place. Urethane foam is a cellular plastic that can be foamed by reacting a urethane chemical mixture in the presence of a suitable blowing agent. The blowing agent produces the gas necessary for foaming.

The armor assembly 10 may be made by providing two sheets of glass fiber reinforced plastic material corresponding to the front and rear walls 42 and 44 of the casing, two strips of the same material corresponding to the side walls 38 of the casing and two strips of the same material corresponding to the end walls 40 of the casing. A shallow open top molding box is provided, the bottom wall of which has the same rectangular dimensions as the front and rear walls 42 and 44 of the casing. One of the two sheets is then placed on the bottom of the molding box, and the four strips corresponding to the side and end walls of the casing are placed on edge or upright along the four edges of the bottom sheet, the strips being supported by the side and end walls of the box. The pre-assembled panel unit 16 is then placed on the bottom sheet with the space retainers in register with the holes 55 in the bottom sheet and the urethane chemical mixture including blowing agent is poured in, after which the second of the two sheets is laid on the top edges of the four upstanding strips to close the casing. The urethane chemical mixture is activated and expands to completely fill the space within the casing and encapsulate the panel unit 16. If the heat of the foaming action of the urethane is not enough to heat seal the edges of the sheets and strips forming the casing, additional heat may be provided.

Figure 6:
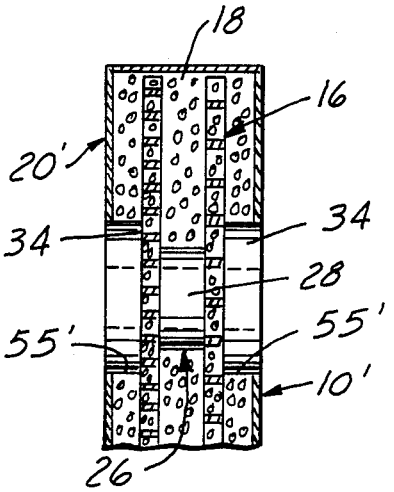
FIG. 6 is a view similar to FIG. 3, omitting the mounting stud fastener and showing an armor assembly of modified construction.

FIG. 6 shows a modification in which the armor assembly 10′ differs from the armor assembly 10 in that the holes 55′ in the front and rear walls of the casing 20′ are enlarged so that the nuts 34 can project through such holes flush with the outer surfaces of the front and rear walls.

The armor assembly 10 or 10′ has a lower specific gravity than water so as not to increase the weight of an amphibious vehicle when in the water.

I claim:

1. A self-contained armor assembly comprising a panel unit including a pair of armor plates each having opposite sides and peripheral edges, means for clamping said armor plates together in spaced, generally parallel relation, a casing in which said panel unit is housed, said armor plates being spaced from said casing along their opposite sides and peripheral edges, a foamed resinous plastic material in said casing filling the space between said armor plates and said casing and in which said armor plates are completely embedded and encapsulated, said means for clamping said armor plates together comprising a plurality of space retainers, said space retainers extending through openings in said armor plates and each having an enlarged central body portion and reduced end portions, and means on said reduced end portions to clamp said armor plates against said central body portion.

2. A self-contained armor assembly as defined in claim 1, wherein said casing is of plastic material and said casing and foamed resinous plastic material provide a sealed package to protect said armor plates from the elements.

3. A self-contained armor assembly and mounting means therefor, said armor assembly comprising a panel unit include a pair of armor plates each having opposite sides and peripheral edges, means for clamping said armor plates together in spaced, generally parallel relation comprising a plurality of elongated, tubular space retainers, said space retainers extending through openings in said armor plates and each having an enlarged central body portion and reduced end portions, means on said reduced end portions clamping said armor plates against said central body portion, a casing in which said panel unit is housed, said armor plates being spaced from said casing along their opposite sides and peripheral edges, and a foamed resinous plastic material in said casing filling the space between said armor plates and said casing and in which said armor plates are completely embedded and encapsulated, said mounting means comprising a plurality of elongated mounting stud fasteners each removably extending through said casing and through one of said tubular space retainers, and means on each mounting stud fastener for removably retaining said armor assembly thereon.

* * * * *